United States Patent [19]

Butterbaugh

[11] Patent Number: 4,957,026

[45] Date of Patent: Sep. 18, 1990

[54] FOOD PREPARATION APPLIANCE FOR SCULPTURING FRUITS AND VEGETABLES

[76] Inventor: Jack R. Butterbaugh, 3213 S. Parnell, Apt. 2R, Chicago, Ill. 60616

[21] Appl. No.: 411,047

[22] Filed: Sep. 22, 1989

[51] Int. Cl.[5] ..... B26D 3/26

[52] U.S. Cl. ..... 83/870; 83/49; 83/411.7; 83/414; 83/451

[58] Field of Search ..... 83/870, 49, 222, 410.7, 83/411.7, 267, 412, 414, 451

[56] References Cited

U.S. PATENT DOCUMENTS

| | | | |
|---|---|---|---|
| 1,482,735 | 2/1924 | Catsules . | |
| 1,820,342 | 8/1931 | Boehmer | 83/411.7 |
| 2,560,229 | 7/1951 | Leavens . | |
| 2,625,972 | 1/1953 | Torres . | |
| 2,711,200 | 6/1955 | Johnson, Jr. | 83/870 X |
| 3,099,303 | 7/1963 | Anderson et al. . | |
| 3,138,186 | 6/1964 | Laudien . | |
| 3,220,110 | 11/1965 | Popeil . | |
| 3,431,955 | 3/1969 | Heymann | 83/267 |
| 3,673,920 | 7/1972 | Wahlen et al. | 83/411.7 X |
| 3,680,614 | 8/1972 | Polk, Jr. . | |
| 4,038,894 | 8/1977 | Knibbe et al. . | |
| 4,320,680 | 3/1982 | de la Cruz et al. | 83/870 |

*Primary Examiner*—Hien H. Phan
*Assistant Examiner*—Eugenia A. Jones
*Attorney, Agent, or Firm*—Jon Carl Gealow

[57] ABSTRACT

A food preparation appliance for cutting generally spherical food items into two portions, with the complimentary cut edges being of a fanciful design. The appliance adjustably supports the food item with respect to a cutting head, such that the cutting head may be moved toward and into the food item to cut it at a desired location. A drive mechanism is provided to rotate the food item in response to the cutting head being moved toward the food item, after being retracted therefrom, such that successive cuts will normally form a continuous cut around the food item to separate the food item into two portions, each of which has a fanciful cut edge.

32 Claims, 8 Drawing Sheets

FIG. 1
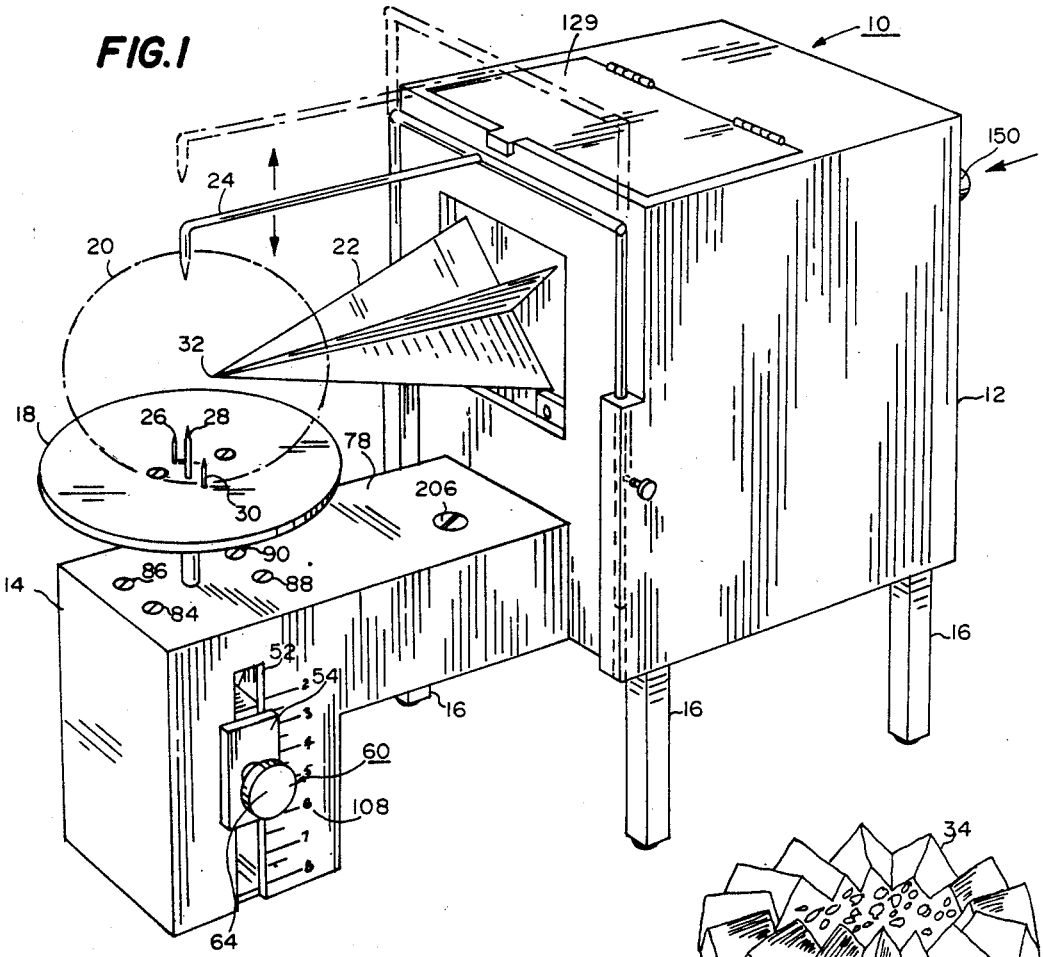
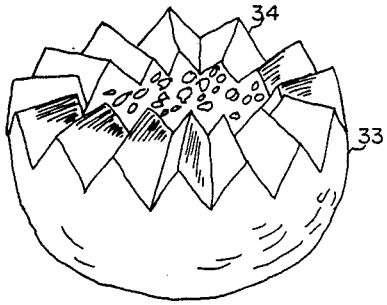
FIG. 3
FIG. 2
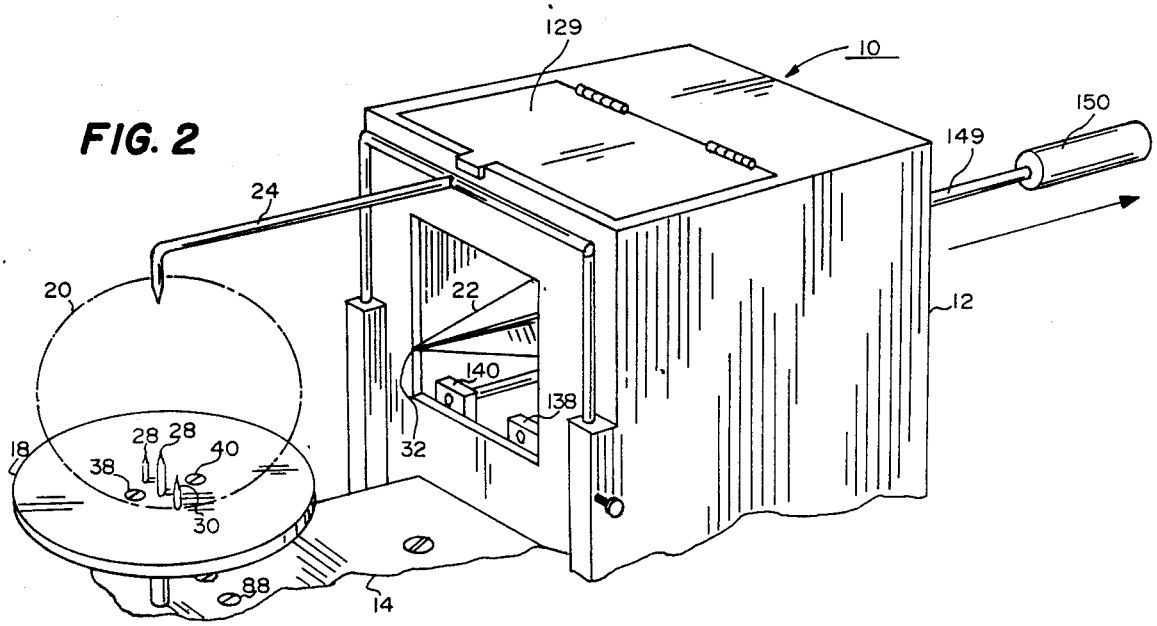

FIG. 4
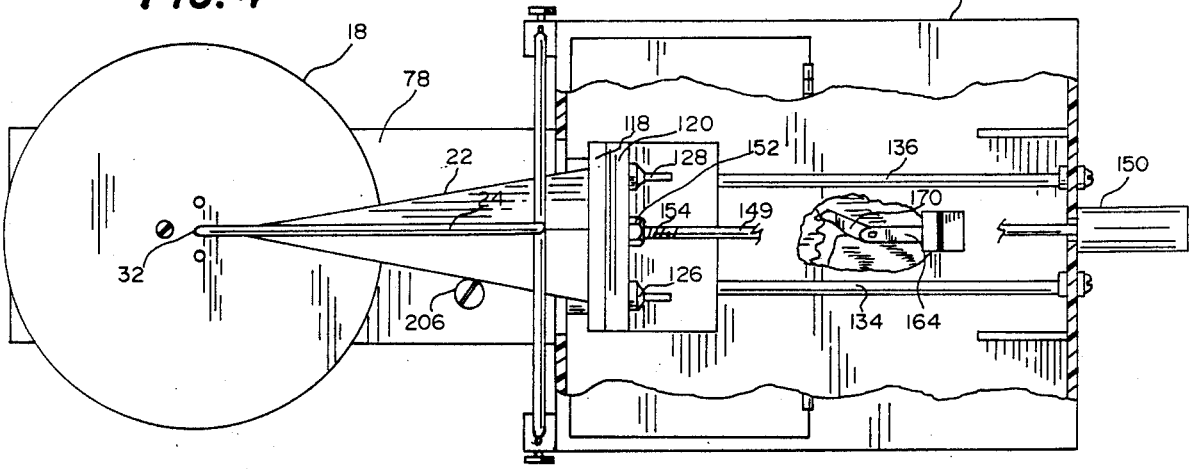
FIG.5
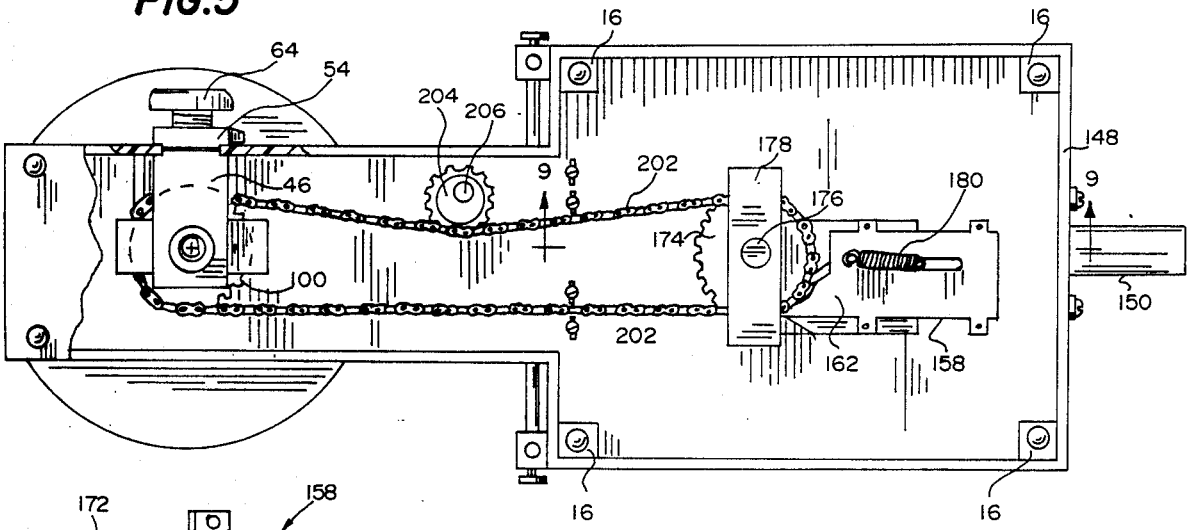
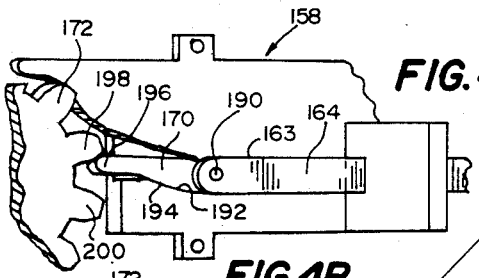
FIG.4A
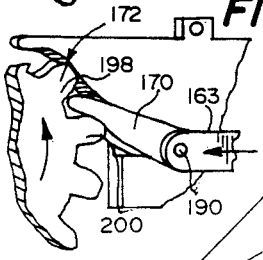
FIG.4B
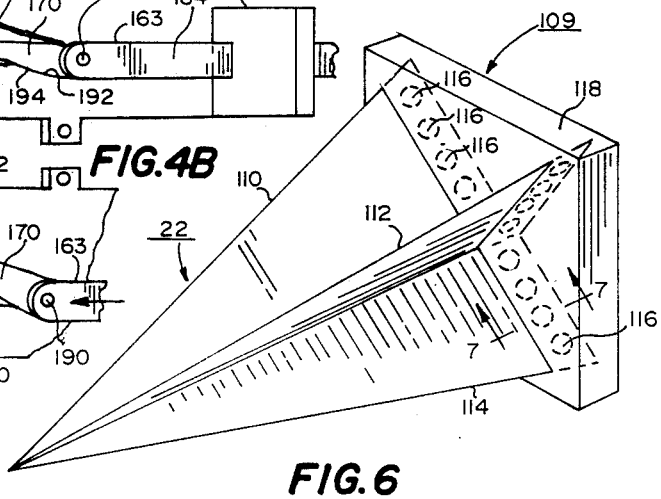
FIG.6
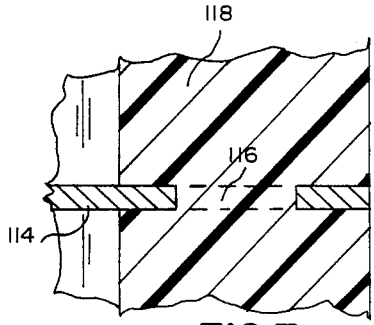
FIG.7

FIG. 17
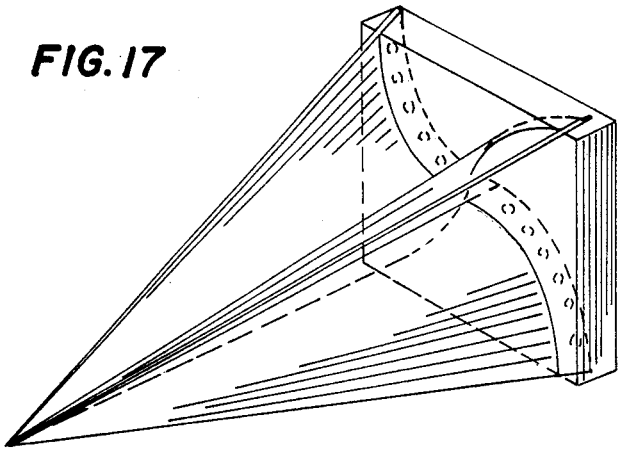
FIG. 18
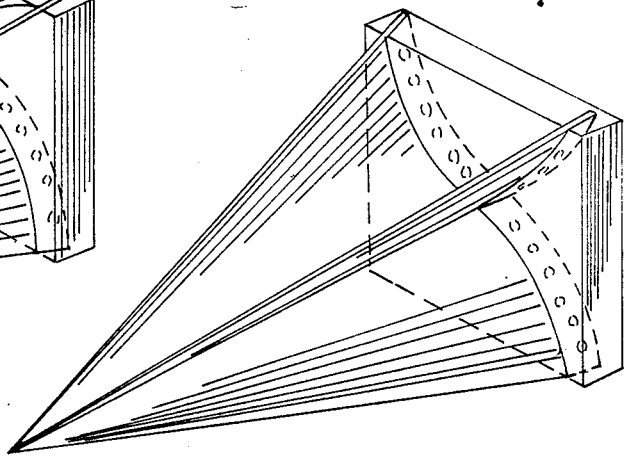
FIG. 19
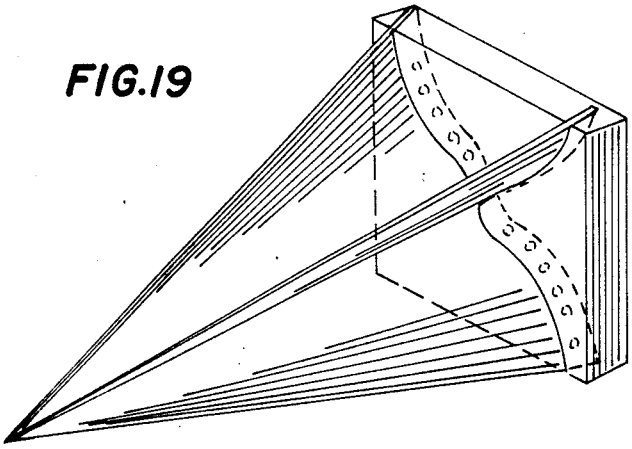
FIG. 20
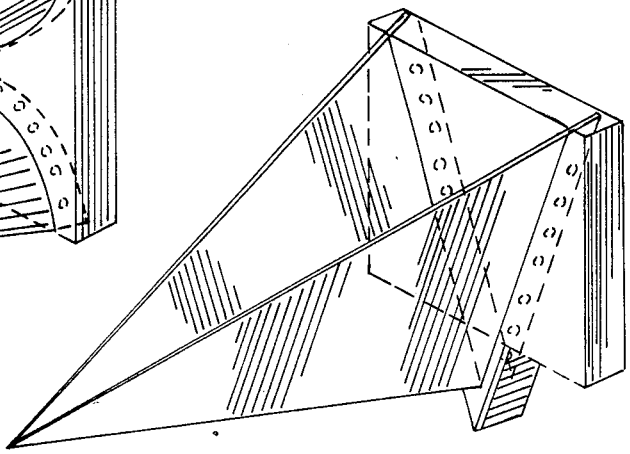
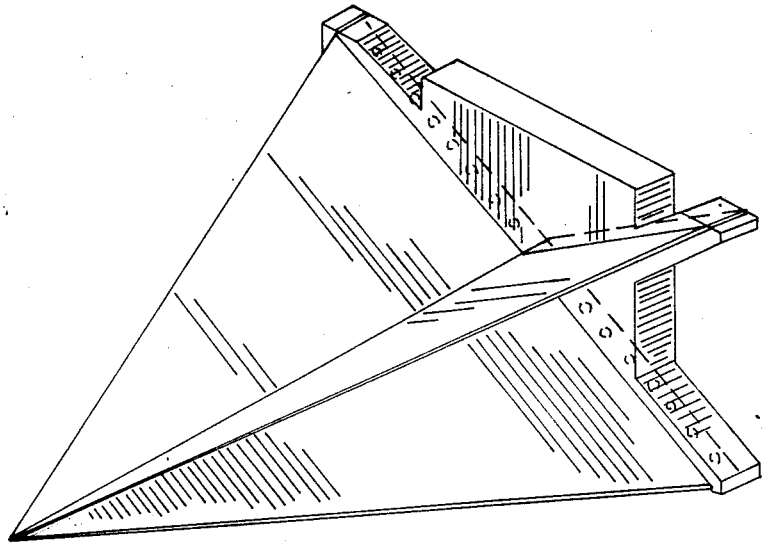
FIG. 21

FOOD PREPARATION APPLIANCE FOR SCULPTURING FRUITS AND VEGETABLES

BACKGROUND OF THE INVENTION

1. FIELD OF THE INVENTION

This invention relates to food preparation appliances in general, and more particularly to a food preparation appliance for cutting food items, preferable those with a generally spherical shape into two portions, with the cut surface of each portion being of a fanciful and pleasing design. The food preparation appliance of this invention makes it possible for an unskilled person to cut generally spherical fruits or vegetables, such as oranges, into two portions, with the complementary cut surfaces of each portion having fanciful and pleasing profiles. Once set up for a particular size of fruit or vegetable, a large number of the fruits or vegetables can be quickly prepared with uniform results.

2. BACKGROUND INFORMATION

It has long been the custom to cut generally spherical food items such as oranges or lemons in half, the cut surface being of a fanciful design such as might be described as sawtoothed, notched or wavy. The cutting of fruits and vegetables to produce a decoratively cut edge has in the past been accomplished by hand. However, a considerable degree of manual dexterity and experience is required to produce attractively cut fruits and vegetables at an acceptable rate. While a person with a high degree of skill might be able to render such a fanciful design with an ordinary knife, even a skilled person would spent considerable time in preparing each individual fruit or vegetable. Fruits and vegetables can be severed into two portions having complementary decoratively cut edges by use of specifically shaped knife blades. For instance, the use of a V-shaped knife blade provides a serrated edge. Devices have been disclosed in the past to simplify the preparation of food items in this manner by providing specially designed cutting implements and cutting guides. For example, U.S. Pat. No. 1,482,735—Catsules reveals a kitchen utensil comprising an expansible ring having a fancy edge which is intended for use with a knife having an edge conforming in shape to the edge of the ring.

U.S. Pat. No. 4,320,680—de la Cruz et al. reveals a fruit cutter having a base supporting a stand for a cup which supports the fruit. The rim of the cup is provided with cutaway sections which are engaged by a detent ball of a marker which is also supported by a stand projecting from the base. The base is also provided with a stand which supports a knife for reciprocal movement into and out of the fruit. A plurality of V-shaped knife blades of varying sizes are provided to accommodate fruits of varying sizes. In order to cut a fruit with this cutter, it is necessary to first adjust the heights of the stands for the marker and the knife to accommodate the fruit to be cut, and to choose a V-shaped knife blade of appropriate size. With the detent ball engaged in a cutaway section, the V-shaped knife blade is moved into the fruit to cut it and then extracted. The fruit cup is then rotated to engage the detent ball in another cutaway section, and another cut is made in the fruit by the V-shaped knife blade. This process of alternately positioning the fruit cup and cutting the fruit is repeated until the fruit is cut into two pieces.

SUMMARY OF THE INVENTION

In accordance with this invention, a food preparation mechanism or appliance is provided to cut generally spherical fruits and vegetables of various sizes along a circular cross section to form either two substantially equivalent pieces having a decorative edge, or to cut the fruit or vegetable off of the center circumference line to form two unequal pieces. The food preparation appliance includes a food support member adjustably supported on a housing such that the fruit or vegetable to be cut can be properly positioned for engagement by the cutting edges of knife blades included in a food cutting assembly which is also supported on the housing. The appliance also includes a drive train which causes the fruit or vegetable to be repositioned after the knife is inserted into the fruit or vegetable, and prior to the next insertion, such that successive cuts will form a continuous cut around the circumference of the fruit or vegetable.

The appliance can be used to split any food item having a circular cross-section, but has particular applicability in the cutting of fruits and vegetables. It is often desirable to sever fruit using a decorative edge cut, rather than a planer cut as would be readily made with an ordinary knife. Preparers of food such as caterers, restaurants, airlines, cruise vessels, clubs and institutions have utilized decoratively cut fruit and vegetables for many years to enhance the visual appearance of foods.

The food preparation mechanism of this invention will accept interchangeable knife blades designed to cut different patterns. For example, a petal-shaped knife blade, a scalloped edge knife blade, a V-shaped knife blade, and a water-wave-shaped knife blade. The appliance of this invention permits the decorative cut to be made above or below the widest circumference of the fruit or vegetable, such that the food item can be used as a container with a lid when the pulp is scooped from the interior of the food item. The appliance will uniformly cut a curvilinear object, such as a fruit or vegetable, in equivalent or unequivalent sections, with each section having a decorative edge.

In the preferred form of this invention, the food support member is an exposed elevatable turntable located at one end of the housing, with the other end of the housing providing an enclosure for the cutting assembly. The housing encloses a support arrangement for the turntable which provides means for adjusting the elevation of the turntable. It also encloses means for causing rotation of the turntable.

To prepare a fruit or vegetable using the food preparation mechanism of the invention, a fruit or vegetable is placed on the turntable and secured for rotation with the turntable by small prongs protruding from the surface of the turntable. A single prong on an overhead arm supported by the housing is lowered into the top surface of the fruit or vegetable to secure it for rotation with the turntable.

The cutting assembly includes means for supporting a cutting head for reciprocal movement with respect to the turntable. An operating handle is provided for moving the cutting head toward and away from the turntable. A reciprocating portion of the cutting assembly engages a primary portion of a drive means for rotating the turntable when the cutting head is retracted from the fruit or vegetable. This engagement is transmitted from the primary portion of this drive means to a secondary portion which causes the turntable to rotate a predetermined amount to the proper position for the next cut. After a predetermined number of reciprocations of the cutting head the turntable will have completed a full revolution and the fruit and vegetable will have been cut into two portions.

BRIEF DESCRIPTION OF THE DRAWINGS

FIG. 1 is a perspective view of the food preparation appliance of this invention, with the food cutting assembly FIG. 2 is a partial perspective view of the food preparation appliance shown in FIG. 1, with the food cutting assembly in the retracted position;

FIG. 3 is a perspective view of a generally spherical food prepared by the food preparation appliance of this invention;

FIG. 4 is a top plan view with portions broken away to show further details of the food cutting assembly of the food preparation appliance shown in FIG. 1;

FIG. 4A is an enlarged to plan view with portions broken away showing a portion of the drive mechanism as the food cutting assembly is being extended toward the food support member.

FIG. 4B is similar to FIG. 4A but shows the position of the drive mechanism with the food cutting assembly fully extended toward the food support member.

FIG. 5 is a bottom plan view with portions broken away to show the drive train of the food preparation appliance in FIG. 1;

FIG. 6 is a perspective view of the detachable cutting head of the food preparation appliance shown in FIG. 1;

FIG. 7 is a cross-sectional view taken along the line 7—7 in FIG. 6;

FIG. 17 is a perspective view similar to FIG. 6 of a second embodiment of a detachable cutting head for the food preparation appliance shown in FIG. 1, which will provide wave-shaped cuts in food prepared by the food preparation appliance;

FIG. 18 is a perspective view similar to FIG. 6 of a third embodiment of a detachable cutting head for the food preparation appliance shown in FIG. 1, which will provide curvilinear valleys and peaks on the cut edge of a prepared food item;

FIG. 19 is a perspective view similar to FIG. 6 of a fourth embodiment of a detachable cutting head for the food preparation appliance shown in FIG. 1 which will provide curvilinear cuts with pointed ends on the cut edge of a prepared food item;

FIG. 20 is a perspective view similar to FIG. 6 of a fifth embodiment of a detachable cutting head for the food preparation appliance shown in FIG. 1, which will provide deep V-shaped cuts on the cut edge of a prepared food item;

FIG. 21 is a perspective view similar to FIG. 6 of a sixth embodiment of a detachable cutting head for the food preparation appliance shown in FIG. 1, which will provide elongated V-shaped cuts on the cut edge of a prepared food item;

DESCRIPTION OF THE PREFERRED EMBODIMENT

Figure 8:
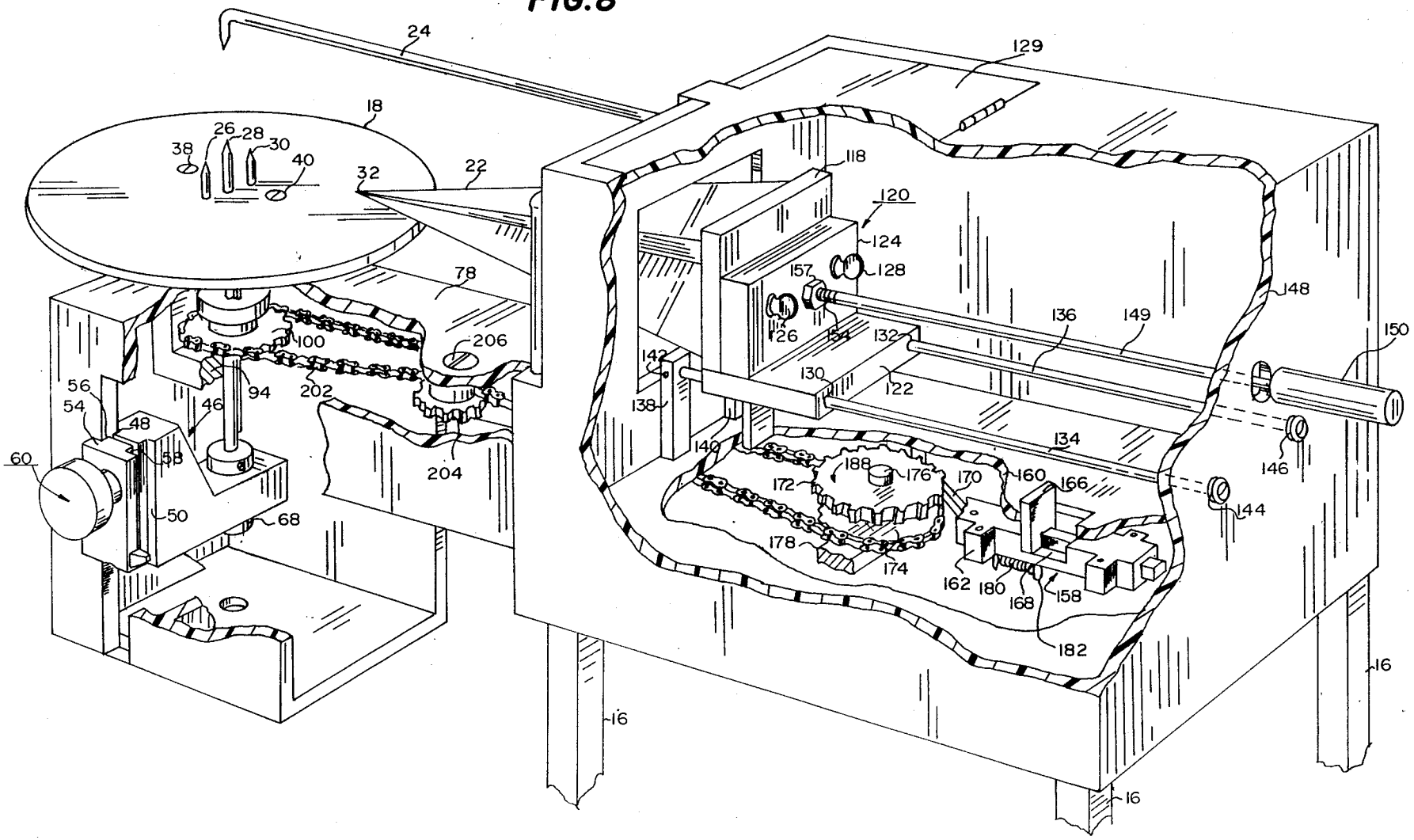
FIG. 8 is an enlarged perspective view of the food preparation appliance shown in FIG. 1, with portions of the housing broken away to show the drive train and height adjusting mechanism for the food support member of the food preparation appliance shown in FIG. 1.

Referring to FIG. 1, the food preparation appliance of this invention includes a housing 10, having a principal portion 12 and an extended portion 14. The principal portion 12 is supported by four legs 16, three of which are shown. Supported by the extended portion 14 of the housing is a food support member or turntable 18 upon which is placed a food product 20, shown by dash lines, which is to be prepared by the food preparation appliance. The principal portion 12 of the housing supports both a food cutting assembly, including a cutting head 22, and a food product holding member 24.

A food product 20 to be prepared for serving by the food preparation appliance is impaled on spikes 26, 28, and 30, which project upwardly from the turntable 18. When impaled on the spikes 26, 28, and 30, the food product 20 will rotate with the turntable. As will hereinafter be described, the height of the turntable 18 is adjustable, such that the food product 20 may be positioned, so that tip 32 of the cutting head 22 will engage the food product 20 at its midpoint. With the height of the turntable 18 properly adjusted, and the food product 20 impaled on the spikes 26, 28, and 30, the holding member 24 is moved downward to pierce the top center of the food product to hold it in position for rotation with the turntable 18. By properly correlating rotation of the turntable 18 with reciprocation of the cutting head 22, a spherical food product, such as an orange 33, may be cut into halves, each of which has a serrated edge 34, as shown in FIG. 3.

Figure 12:
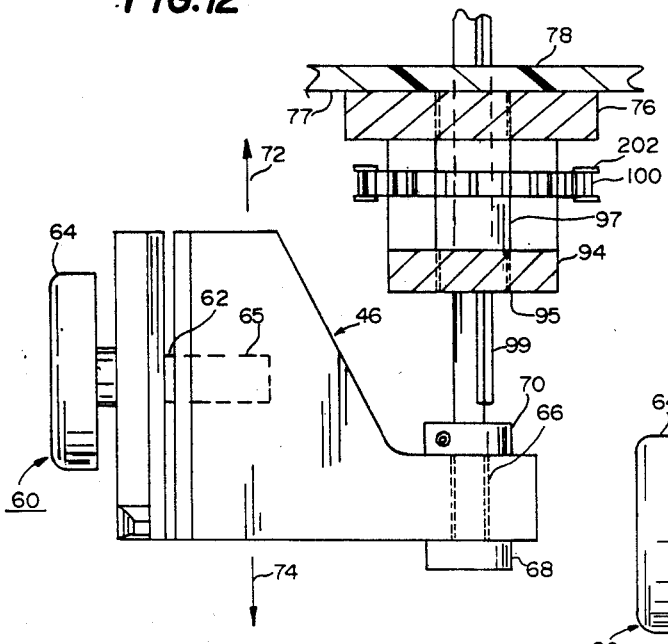
FIG. 12 is a side elevation view, with portions removed, of the height adjusting mechanism shown in FIG. 11, with the food support member in a raised position.
Figure 13:
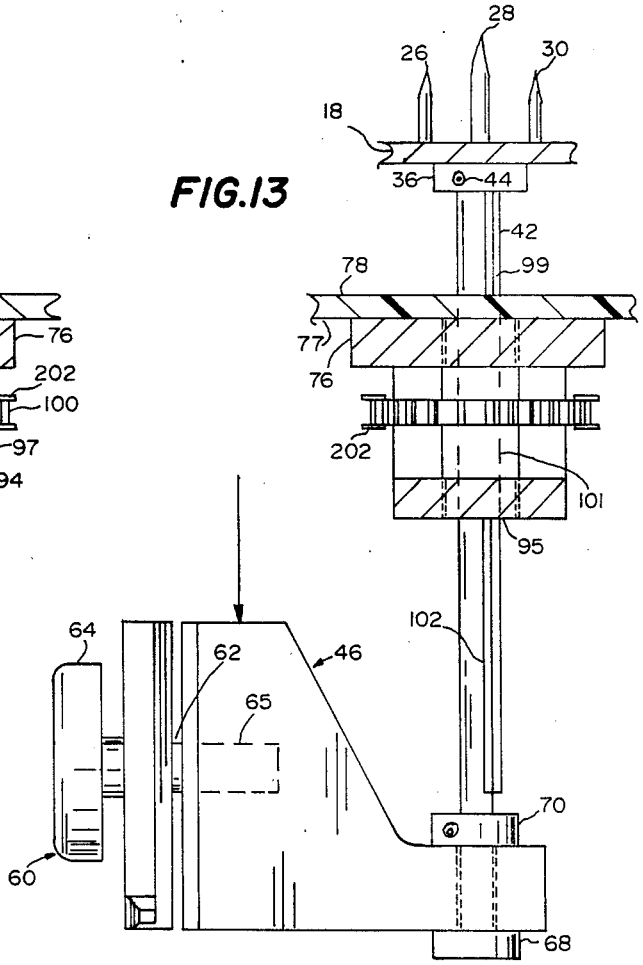
FIG. 13 is a side elevation view, with portions removed, of the height adjusting mechanism shown in FIG. 11, with the with the food support member in a lowered position.

The adjusting means for setting the height of the turntable 18 will now be described by making reference to FIGS. 1, 8, 11, 12 and 13. The turntable 18 is secured to a collar 36 by a pair of screws 38 and 40. The collar 36 is in turn secured to a shaft 42 by a set screw 44, as shown in FIG. 13 The shaft 42 is supported at its lower end by a height adjusting bearing block 46. As shown in FIG. 8, grooves 48 and 50 are provided in the adjusting bearing block 46. A vertical slot 52 is formed in the extended portion 14 of the housing, with the edges of the housing defining the slot being received in the grooves 48 and 50. An adjusting plate 54 is provided with grooves 56 and 58 which also receive the edges of the housing defining the slot 52. A thumb screw 60 having a threaded shaft 62 and a knob 64 is provided to secure the adjusting bearing block 46 and the adjusting plate 54 in the slot 52. The shaft 42 passes through and is free to rotate in an aperture 66 provided in the height adjusting block 46, as shown in FIG. 12. A threaded aperture 65 is provided in the height adjusting block 46 to receive the threaded shaft 62 of thumb screw 60. Rotation of the thumb screw 60 will cause the adjustable plate 54 and the height adjusting block 46 to be pulled toward each other, squeezing the sidewalls of the housing 14 between the grooves 48 and 56 and 50 and 58 so as to clamp the height adjusting block 46 at a desired position within the slot 52.

A pair of collars 68 and 70 are secured to the shaft 42 next to the top and the bottom of the height adjusting block, such that as the height adjusting block is moved upwardly or downwardly as indicated, in FIG. 12, by the arrows 72 and 74, respectively, the shaft 42 and turntable 18 will also be moved up and down.

Figure 11:
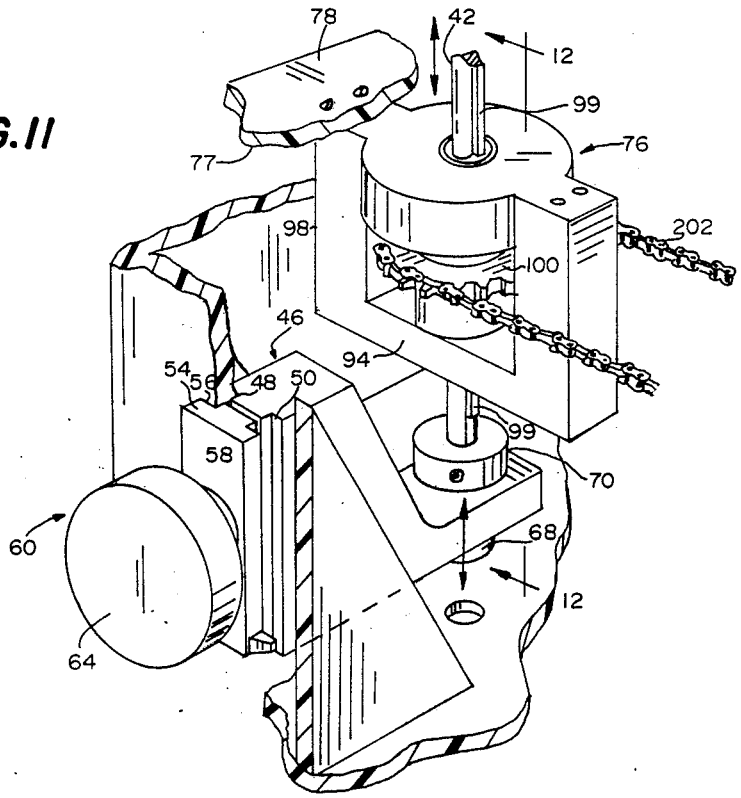
FIG. 11 is an enlarged perspective view of a portion of the food preparation appliance shown in FIG. 1, with portions of the housing broken away to show a portion of the drive train and the height adjusting mechanism.

As shown in FIG. 11, a generally U-shaped shaft and sprocket supporting member 76 is secured to the inside surface 82 of top wall 78 of the extended portion of the housing by a plurality of fasteners, such as screws 84, 86, 88 and 90. The U-shaped support member 76 is formed with a rectangular base 94 and rectangular side legs 96 and 98. An aperture 95 is formed in the base 94 to receive for rotation therein a bushing 97 keyed for rotation with the shaft 42 by a key 99. A sprocket 100 received between the lower surface 77 of top wall 78 and the base 94 is secured to the bushing 97. The bushing 97 is provided with a bore and key slot 101 sized to permit axial movement of the shaft 42 therein. An axial groove 102 is provided in the shaft to receive a portion of the key 99 which causes the bushing 97 and sprocket 100 to rotate with the shaft.

In using the food preparation machine, the height of the turntable 18 is adjusted such that with the food item 20 impaled upon the spikes 26, 28 and 30, the vertical center of the food item will be at the same height as the tip 32 of the cutting head 22. Calibration marks 108 may be provided on the side of the extended portion 14 of the housing adjacent to the slot 52, to aid in correctly positioning the vertical height of the turntable. For instance, the markings could be such that when an indicia on the adjusting plate 54 is aligned with a numeral representing the height of a food item, the vertical midpoint of the food item 20 will be in line with the tip 32.

The cutting head assembly 109, as shown in FIGS. 6 and 7, include four triangular knives, three of which 110, 112 and 114 are shown. The knives are arranged in two parallel perpendicular planes so as to form a pyramid shape. A plurality of holes 116 are provided at the base of the triangular blades, and are positioned to be molded into a rectangular base 118 which may, for instance, be formed of a plastic. As shown in FIG. 7, the plastic material extends through the holes 116 to secure the blades to the base.

Referring to FIG. 4 and 8, the rectangular base 118 of the cutting head 22 is supported by an L-shaped support member 120. The L-shaped support member 120 includes a rectangular base portion 122 and a rectangular vertical portion 124 which is secured to the upper surface of the base 122. As shown in FIG. 8, the rectangular base 118 of the cutting head rests on top of the base member 122 and against the vertical portion 124. Threaded apertures (not shown) are provided in the base 118, to receive the threads of a pair of thumb screws 126 and 128 which are used to secure the base 118 to the L-shaped support member 120. As best shown in FIGS. 1, 2, 8, and 14, a hinged cover 129 is provided in the top of the principal portion of the housing 10 to provide access to the thumb screws 126 and 128 for removing and replacing the cutting head 22.

The rectangular base 122 is provided with a pair of bores 130 and 132 which are coaxial with the central axis of the cutting head 22. A pair of rods 134 and 136 received within the bores 130 and 132 support the L-shaped support member 120 for reciprocation thereon. The rods are in turn supported at each end by the housing 10 The ends of the rods adjacent the extended portion 14 of the housing are supported by a pair of supporting legs 138 and 140. Intersecting holes are provided in each of the legs 138 and 140. One of the holes receives the end of one of the rods, and the other hole is threaded to receive a set screw, one of which 142 is shown, to secure the rods 134 and 136 to the legs 138 and 140, respectively. The other ends of the rods 134 and 136 are supported in apertures 144 and 146, respectively, formed in wall 148 of the housing. The cutting assembly 109 is reciprocated within the principle portion of the housing 12 by manually applying a reciprocating force to a handle 150 which is connected by a rod 149 to the block 124. A nut 152 which is secured to the block 124, is engaged by threads 154 provided on the rod 149.

Such that turn table 18 will be rotated through a pre-determined arc following each retraction of the cutter head from the food item and before its next movement toward the food item, a pawl, gear and chain drive arrangement is provided. This drive arrangement will be described by making reference to FIGS. 4, 4A, 4B, 5, 8, 9, and 10. A slide mechanism 158 is secured to the underside of a base 160 in the principle portion 12 of the housing. The slide mechanism 158 includes a holder 162 which is provided with a slot 163. A rectangular actuating member 164 is received in the slot for reciprocal movement therein. The actuating member 164 is provided with an actuating tab 166. The actuating tab 166 is free to reciprocate with the actuating member in an enlarged portion 168 of the rectangular slot. The end of the actuating member 164 facing the extended portion 14 of the housing is provided with an articulated finger 170. The articulated finger 170 is positioned to engage a ratchet wheel 172. The ratchet wheel 172 and a chain sprocket 174 are mounted on a shaft 176 which is supported for rotation by a bracket 178 which is secured t the bottom surface of the base 160. The actuating member 164 is biased to move toward the left, by a coil spring 180, such that the actuating tab 166 engages the left-hand edge of the enlarged portion 168 of the slot. One end of the coil spring 180 is secured to a pin 182 which is secured to the actuating member 164, while the other end of the spring is secured to a pin 184 near the left end of the holder 162.

Extending from the rectangular base 122 of the cutting assembly 109 is an actuating finger 186. The application of a force to the handle 150 to move the cutting assembly 109 to the right, as viewed in FIGS. 8 through 10, will cause the cutting assembly 109 to move to the right, from the position shown in FIG. 9, to that shown in FIG. 10. As shown in FIG. 10, engagement of the actuating finger 186 with the actuating tab 166 causes the actuating member 164 to be moved to the right as viewed in FIGS. 8, 9, and 10.

As a force is applied to the handle 150 to move the cutting assembly 109 to the left, the tension force of spring 180 will move the actuating member 164 to the left, such that the articulated finger 170 will engage a tooth on the ratchet wheel 172 to rotate the wheel in a counter-clockwise direction as indicated by the arrow 188 in FIG. 8.

Referring to FIGS. 4A and 4B, the manner in which the actuating member 164 causes the ratchet wheel 172 to be rotated in the counter-clockwise direction will be explained. The articulated finger 170 is pivotally mounted to the left end of the actuating member 164 by a pin 190. As the actuating member 164 is moved to the left, the lower edge 192 of the articulated finger engages the sloped edge 194 provided at the left end of the slot 163 in the holder 162. This engagement causes the tip 196 of the articulated finger 170 to be moved upwardly and to the left as viewed in FIGS. 4A and 4B, thereby pushing tooth 198 of the ratchet wheel 172 upward and to the left or in a counter-clockwise direction. It will be noted that when the actuating member 164 reaches the limit of its movement to the left, as shown in FIG. 4B, the articulated finger 170 is in engagement with both the tooth 198, which it engaged to rotate the ratchet wheel, and also the next tooth 200, thereby holding the ratchet wheel in a fixed position. Movement of the actuating member 164 to the left is limited by engagement of the actuating tab 166 with the left edge of the enlarged portion 168 of the slot 163.

Figure 9:
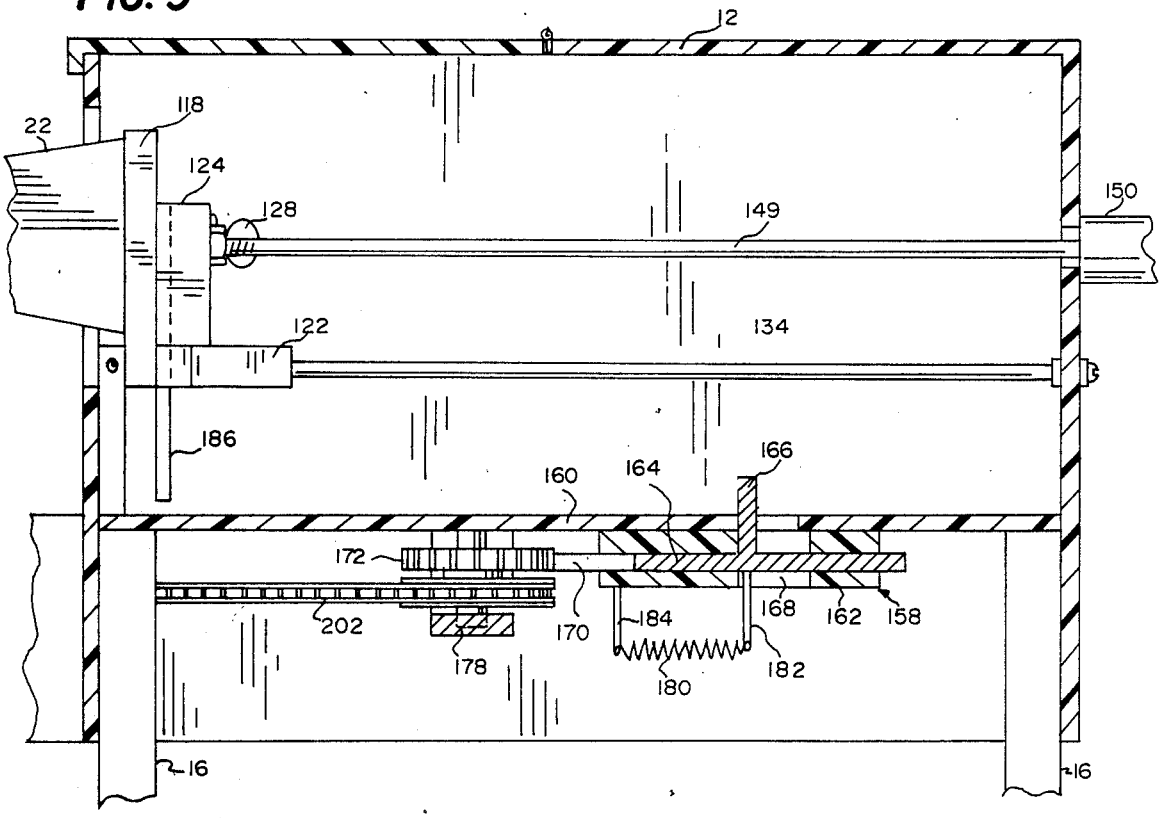
FIG. 9 a side elevation view of a portion of the food preparation appliance shown in FIG. 1, with portions of the housing broken away; to show the food cutting assembly in the extended position.
Figure 10:
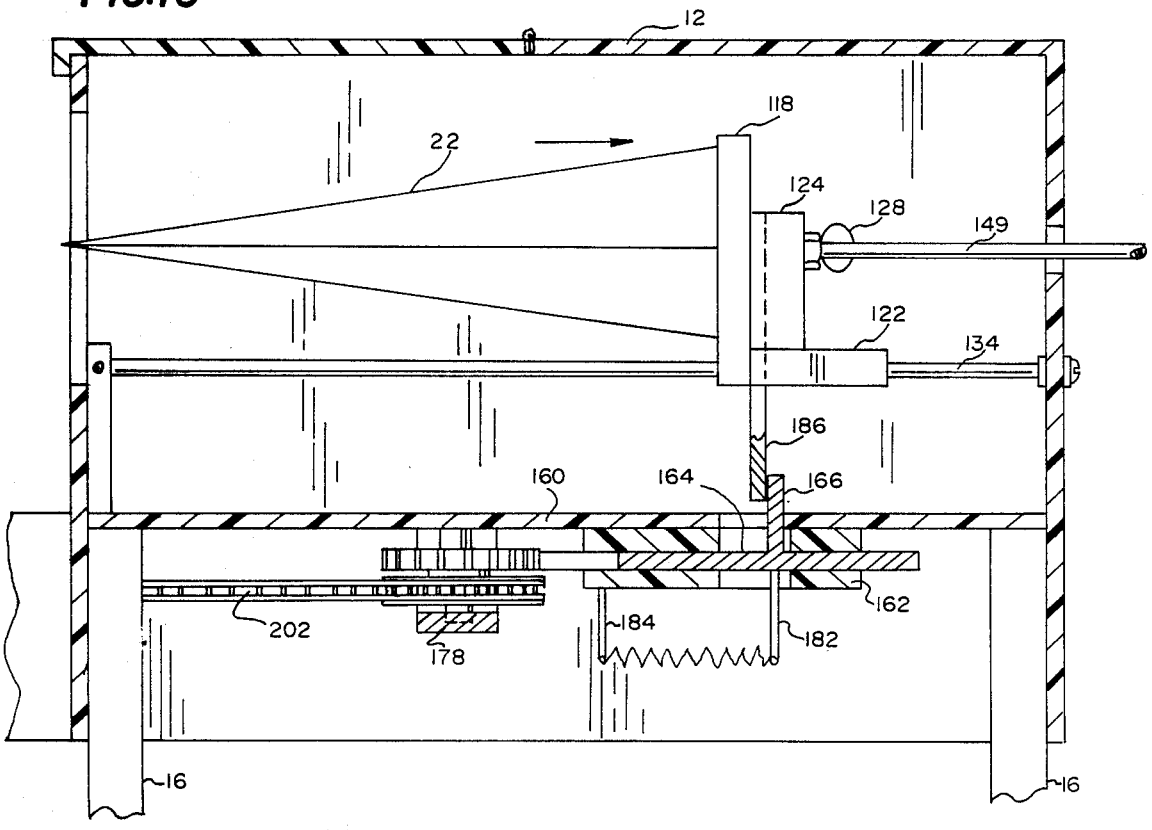
FIG. 10 is a side elevation view of a portion of the food preparation appliance shown in FIG. 1, with portions of the housing broken away to show the food cutting assembly in the retracted position.

It will be observed, by reference to FIGS. 8 through 10, and particularly FIG. 8, that the movement of the actuating member 164 to the left and, therefore, the rotation of the ratchet wheel 172, will have been completed before the tip 32 of the knife blades 110 through 114 engage the food article. Rotation of the ratchet wheel 172 and of the sprocket 174 is imparted to the sprocket 100 and shaft 42 by a drive chain 202. Proper tension is maintained in the drive chain 202 by a sprocket 204 which is eccentrically mounted by a fastener 206 to the lower surface of the top of the extended portion 14 of the housing.

By proper choice of the amount of linear movement of the actuating member 164 and therefore of articulated finger 170, and of the ratio of the number of teeth on the drive sprocket 174 and on the driven sprocket 100, a predetermined arc or number of degrees by which the turntable 18 is rotated is established for each reciprocal movement of the cutting head 22. Referring to FIG. 6, the arc or angle formed between a pair of cutting edges, such as blades 110 and 112, determines the arc through which the drive mechanism should rotate the turntable 18 for each reciprocal movement of the cutting head 22.

Figure 14:
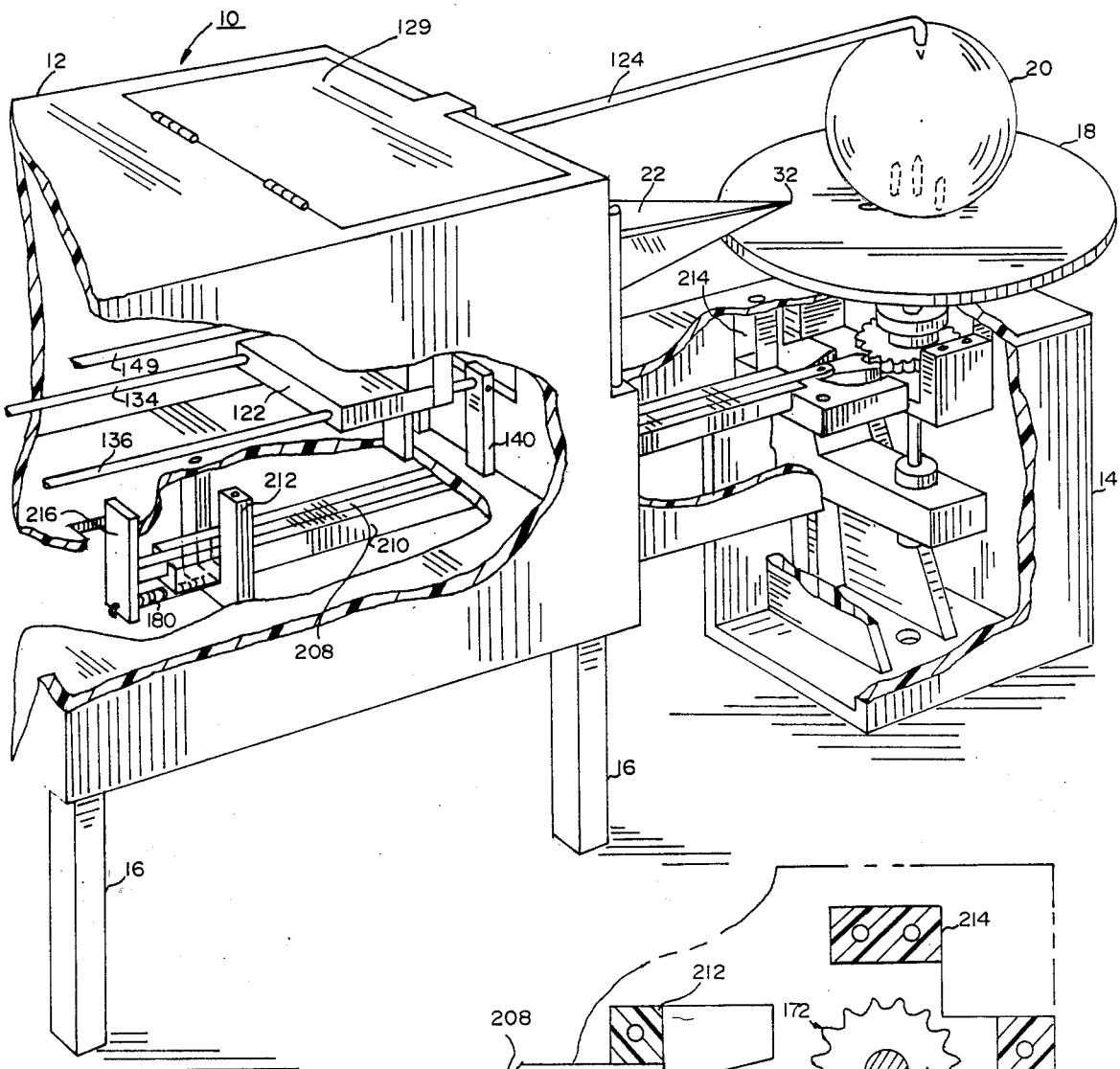
FIG. 14 is a partial perspective view of the food preparation appliance shown in FIG. 1, provided with a second embodiment of the drive mechanism, with the food cutting assembly in a partially retracted position.
Figure 15:
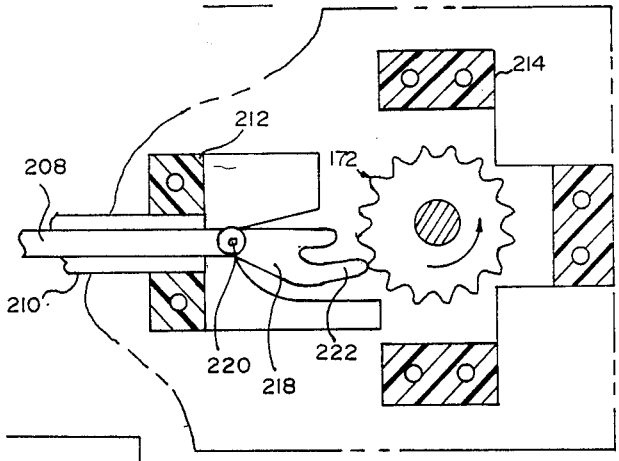
FIG. 15 is an enlarged top plan view showing a portion of the second embodiment of the drive mechanism with the drive mechanism in a retracted position.
Figure 16:
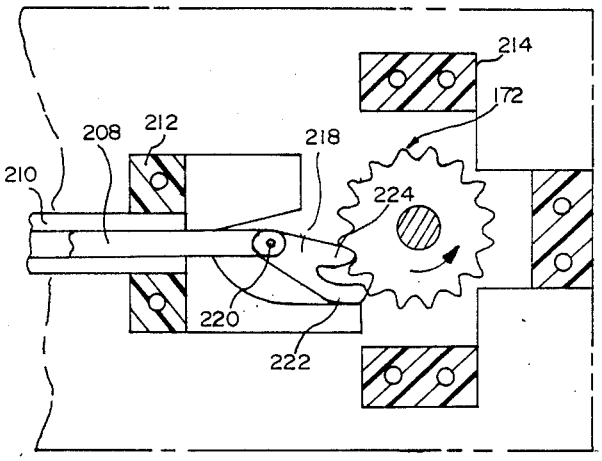
FIG. 16 is a top plan view similar to FIG. 15 with the drive mechanism in the extended position.
Figure 22:
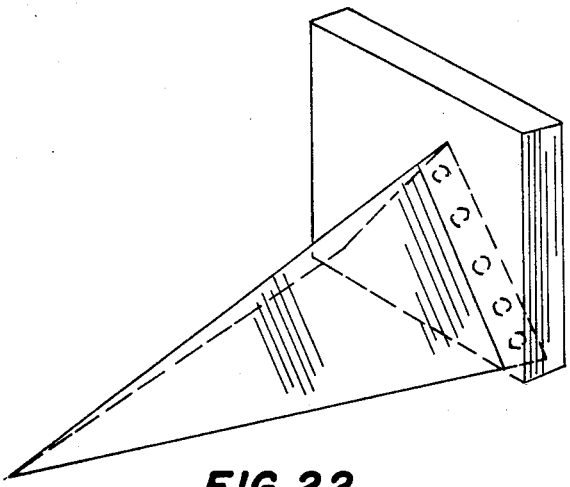
FIG. 22 is a perspective view similar to FIG. 6 of a seventh embodiment of a detachable cutting head for the food preparation appliance shown in FIG. 1, which will provide shallow V-shaped cuts on the cut edge of a prepared food item.

An alternate embodiment of the drive mechanism for causing rotation of the turntable 18 upon reciprocal motion of the cutting head 22 is shown in FIGS. 14, 15, and 16. In FIGS. 14, 15, and 16, like numerals are used to identify components which correspond to those shown in the FIGS. for the first embodiment of the drive mechanism. In this second embodiment of the drive mechanism, the sprockets 100 and 174 and drive chain 202 are replaced by an elongated member 208. The elongated member 208 is supported in a U-shaped channel member 210. The U-shaped channel member is in turn supported by a pair of U-shaped brackets 212 and 214. U-shaped bracket 214 is supported from the inside surface 77 of the top wall 78 of the extended portion 14 of the housing. Similarly, U-shaped bracket 214 is supported by the undersurface of the base 160 of the principle portion 12 of the housing. An actuating tab 216, similar to actuating tab 166, is secured to one end of the elongated member 208. An articulated finger 218 is pivotally mounted at the opposite end of the elongated member 208 by a pin 220. As in the case of the first embodiment, engagement of the actuating tab 216 by tab 186 moves the elongated member 208 to the left, as viewed in FIG. 14, to disengage the articulated finger 218 from the ratchet wheel 172 As the cutting head 22 is moved to the right, as viewed in FIG. 14, by the application of a force to the handle 150, the articulated finger 218 first moves to the position shown in FIG. 15. As the elongated member 208 is moved further to the right, a first tooth 222 of the articulated finger 218 engages the upper surface of a tooth on the ratchet wheel 172. Further movement cf the elongated member 208 to the right causes the actuating finger to pivot clockwise about pin 220 and the ratchet wheel 172 to turn counter-clockwise. Under the bias of the spring 180, the elongated member 208 is moved to its right-most position as shown in FIG. 16. In that position, both the first tooth 222 and a second tooth 224 are engaged with teeth on the ratchet wheel 172. With both of the teeth 222 and 224 engaging the ratchet wheel 172, rotation of the turntable 18 is prevented. Again as in the first embodiment, the number of teeth on the ratchet wheel 172 is chosen to provide the desired degree of arcuate rotation of the turntable 18 for each reciprocal movement of the cutting head 22.

Figure 23:
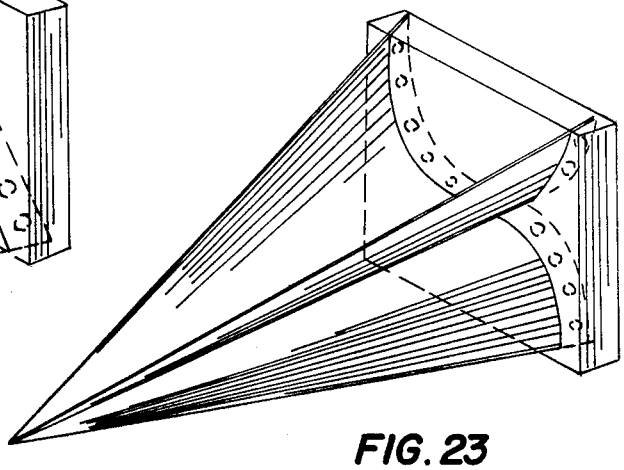
FIG. 23 is a perspective view similar to FIG. 6 of an eighth embodiment of a detachable cutting head for the food preparation appliance shown in FIG. 1, which will provide curvilinear scallop-type cuts on the cut edge of a prepared food item.

In FIGS. 17 through 23, alternate embodiments of the cutting head are shown. Each of these cutting heads will provide a different type of cut edge on the food processed by the food preparation appliance. When the cutting head shown in FIG. 17 is used to cut a spherical food, a scalloped cut edge will result which has a "water wave-shape". The cutting head shown in FIG. 18 will provide a scalloped edge having sharp peaks. The cutting head shown in FIG. 19 will provide sharp upward and downward peaks on each half of the processed food item, with gently curved cuts therebetween. The cutting head shown in FIG. 20 will provide a deep V-shaped cut, while that shown in FIG. 21 will provide a shallower and wider V-shaped cut. When utilizing the cutting head shown in FIG. 21, the cutting head 22 would normally not be engaged with the food item to be cut upon each reciprocation of the cutting head. Rather, on alternate strokes, the knob 64 would be moved forward only sufficiently to permit the turntable drive mechanism to move the turntable to its next position, and then the knob would be pulled backward without the blade having engaged the food to be cut. Then, on the next forward motion the cutting head 22 would be moved forward sufficiently to pierce the food item to its center, thus providing a cut whose arcuate or angular extent is twice that of a cutting head, such as shown in FIG. 6. The cutting head shown in FIG. 22, if positioned at the midpoint of the height of a food item, will provide unequal portions, as compared to that shown in FIG. 6, but with a cut edge which has a greater height. FIG. 23 is still another embodiment of a cutting head which will provide a different shape on the cut surface of the food item.

Figure 24:
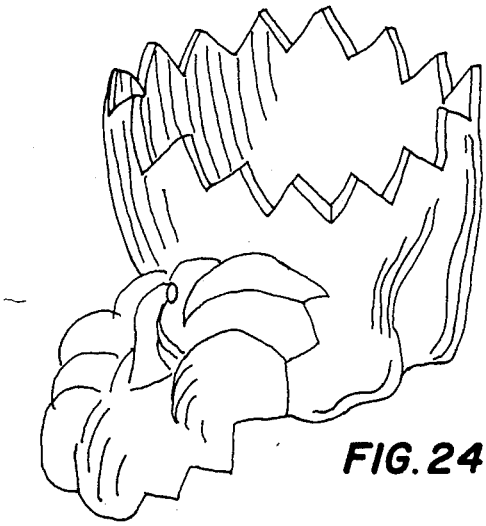
FIG. 24 is a perspective view of a pepper prepared by the food appliance of this invention utilizing the detachable cutting head shown in FIG. 22.
Figure 25:
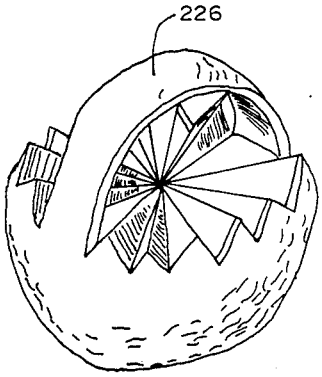
FIG. 25 is a perspective view of a general spherical food, such as an orange, prepared by the food preparation appliance of this invention utilizing the cutting head shown in FIG. 22 in a modified manner.

Two further examples of food products processed by the food preparation appliance of this invention are shown in FIG. 24 and 25. In FIG. 24, a pepper is shown after having been processed by the food preparation appliance of this invention. In processing a pepper, as shown in FIG. 24, the turntable is positioned such that the cutting blade is positioned near the top of the pepper, rather than at the center of the pepper as was the case with respect to the orange shown in FIG. 3. FIG. 25 shows still another spherical food item which has been processed by the appliance of this invention. In order to provide the handle 226 on the food item, which is shown as an orange, the cutting head is not moved to the fully forward position to cut the orange, but rather the knob 64 is moved forward only enough to permit the turntable drive mechanism to rotate the turntable to its next position. By omitting the cutting in one or more successive positions, a handle of varying widths may be provided.

While preferred embodiments of the food preparation mechanism of this invention have been described, other embodiments of the invention will be apparent to those skilled in the art. For instance, in the embodiment shown, the height of the turntable 18 is adjusted to provide the correct positioning of the food item with respect to the cutting head 22. It would, of course, be possible to have the height of the turntable 18 fixed and adjust the height of the cutting head 22 with respect thereto. While a sprocket and chain drive arrangement is shown, it would also be feasible to use a timing belt and timing wheels in place of the chain and sprockets. Further, it would also be possible to extend a drive shaft between the shafts 42 and 172, with appropriate spur gears mounted on each of the shafts.

If the food production mechanism is to be used in a highly automated kitchen, it would be apparent to those skilled in the art to provide electrical drive means. That is, rather than applying a reciprocating force to the handle 150 to operate the mechanism, either a solenoid drive or, for instance, a rotating motor with a rack and pinon drive could be provided. Further, the turntable 18 could be rotated by an electrical stepping motor, the supply energy to which is controlled by limit switches actuated by reciprocation of the cutting head 22. Further, the particular shape of the housing in which the food preparation mechanism is assembled is not critical, and could be of any desired shape. Further, the housing could include a cover with a interlocking arrangement, such that the cover could be opened to place the food item on the turntable, but would have to be closed before the mechanism would operate to cut the food item.

While in accordance with the United States Patent Statutes, preferred embodiments of the invention have been shown and described, various changes may be made in the food preparation machine of this invention, without departing from the true spirit and scope of this invention.

I claim:

1. A food preparation mechanism comprising:

a housing, a food support member supported by said housing, said food support member including a holding mean for retaining a food product, on said food support member, a food cutting assembly supported by said housing, an adjusting means supported by said housing, said adjusting means being effective to adjust the relative positions in which said food support member and said food cutting assembly are supported with respect to each other by said housing, a reciprocating means supported by said housing, said reciprocating means being effective to provide reciprocating movement with respect to each other of said food support member and said food cutting assembly, a drive train mounted on said housing, said drive train being responsive to said reciprocating movement to change the position of said food support member with respect to said food cutting assembly, whereby reciprocating movement of said food cutting assembly causes a predetermined change in the position of said food support member with respect to said food cutting assembly, such that with each successive reciprocating movement toward each other of said food support member and said food cutting assembly, said food cutting assembly engages and cuts the food product in successive predetermined positions so as to form a continuous cut in said food product.

2. The food preparation mechanism of claim 1, wherein said food support member is mounted on said housing for rotary motion with respect to said housing to permit a change in position of said food support member with respect to said food cutting assembly.

3. The food preparation mechanism of claim 2, wherein said food support member is mounted on a shaft which is supported for rotation on said housing.

4. The food preparation mechanism of claim 3, wherein said holding means includes at least two food product engaging members, which when engaged with the food product cause the food product to rotate with said food support member.

5. The food preparation mechanism of claim 4, wherein said at least two food product engaging members project from said food support member, the food product being impaled upon said food product engaging members.

6. The food preparation mechanism of claim 5, wherein one of said food product engaging members is coaxial with said shaft.

7. The food preparation mechanism of claim 6, wherein an additional food product engaging member is provided which projects toward said food support member to impale the food product, and is coaxial with said shaft, such that as said food support member rotates, said food product rotates about an axis coaxial with said shaft.

8. The food preparation mechanism of claim 1, wherein said food cutting assembly includes at least one knife blade having a cutting edge facing toward a food product on said food support member, an increasing portion of said cutting edge engaging said food product with movement of said food cutting assembly and said food support member toward each other.

9. The food preparation mechanism of claim 8, wherein said food cutting assembly includes at least two knife blades each of which has a cutting edge facing toward a food product on said food support member, increasing portions of said cutting edges engaging said food product as said food cutting assembly and said food support member are moved toward each other.

10. The food preparation mechanism of claim 9, wherein said cutting edges of said at least two knife blades come to a point along the axis of reciprocating movement, such that said point first pierces the food product, and increasing portions of said cutting edges engage said food product with movement of said food cutting assembly and said food support member toward each other.

11. The food preparation mechanism of claim 10, wherein the limit of reciprocating movement toward each other of said food support member and said food cutting assembly is reached when said point is located approximately on the axis of rotation of said shaft.

12. The food preparation mechanism of claim 1, wherein said adjusting means is effective to adjust the position of said food support member with respect to said housing.

13. The food preparation mechanism of claim 1, wherein said food cutting assembly is supported for reciprocating movement by said housing, and said reciprocating means is effective to provide reciprocating movement to said food cutting assembly.

14. The food preparation mechanism of claim 13, wherein said reciprocating means includes an operating means which provides the forces necessary to cause reciprocating movement of said food cutting assembly.

15. The food preparation mechanism of claim 14, wherein said operating means includes a manual actuating means extending outside of said housing, whereby forces may be applied to said manual actuating means to cause reciprocating movement of said food cutting assembly.

16. The food preparation mechanism of claim 3, wherein said drive train includes:

a drive means supported for rotation on said housing, a driven means secured to said shaft for rotation with said shaft, a coupling means connecting said drive means and said driven means to cause said shaft to rotate in response to rotation of said drive means, a motion imparting mechanism which is actuated by a reciprocating movement of said food support member and said food cutting assembly to cause a predetermined amount of rotation of said drive means, which rotation in turn causes a predetermined amount of rotation of said driven means and said shaft.

17. The food preparation mechanism of claim 16, wherein said drive means is a first sprocket, said driven means is a second sprocket, and said coupling means is a chain which extends between and engages said first and second sprockets.

18. The food preparation mechanism of claim 17, wherein a second shaft is provided, said first sprocket being secured to said second shaft for rotation therewith, said motion imparting mechanism including a ratchet wheel secured to said second shaft for rotation therewith, a slide member having a finger which engages said ratchet wheel to cause a predetermined amount of rotation of said driven means for each complete reciprocating movement with respect to each other of said food cutting assembly and said food support member.

19. The food preparation mechanism of claim 18, wherein the slide member is caused to move away from said ratchet wheel by each movement apart from each other of said food cutting assembly and said food support member, a resilient member causing said slide member and said finger to move toward and engage said ratchet wheel to rotate said second shaft in response to movement toward each other of said food cutting assembly and said food support member.

20. The food preparation mechanism of claim 3, wherein said adjusting means supports said shaft and is effective to adjust the position of said shaft and food support member mounted on said shaft with respect to said housing.

21. The food preparation mechanism of claim 8, wherein said food cutting assembly is supported for reciprocating movement by said housing, and said reciprocating means is effective to provide reciprocating movement to said food cutting assembly.

22. The food preparation mechanism of claim 21, wherein said at least one knife blade is substantially retracted into said housing when said food cutting assembly reaches the limit of its reciprocating movement away from said food support member.

23. The food preparation mechanism of claim 21, wherein said reciprocating means includes an operating means which provides the forces necessary to cause reciprocating movement of said food cutting assembly.

24. The food preparation mechanism of claim 23, wherein said operating means includes a manual actuating means extending outside of said housing, whereby forces may be applied to said manual actuating means to cause reciprocating movement of said food cutting assembly.

25. The food preparation mechanism of claim 8, wherein said food cutting assembly includes a detachable portion, said detachable portion including said at least one knife blade.

26. The food preparation mechanism of claim 25, wherein at least two detachable portions are provided, said at least one knife blade of each of said detachable portions may be of a different shape, such that said detachable portions will form continuous cuts having different profiles in food products prepared by the food preparation mechanism.

27. The food preparation mechanism of claim 8, wherein said cutting edge of said at least one knife blade forms a straight line.

28. The food preparation mechanism of claim 8, wherein said cutting edge of said at least one knife blade forms a curved line.

29. The food preparation mechanism of claim 8, wherein said food cutting assembly includes four knife blades, said cutting edge of each of said knife blades forming a straight line, and said blades being arranged in two planes which are perpendicular to each other so as to form an X-shaped cut in the food product.

30. The food preparation mechanism of claim 8, wherein said food cutting assembly includes four knife blades, said cutting edges of said at least four knife blades come to a point along the axis of reciprocating movement, such that said point first pierces the food product, and increasing portions of said cutting edges engage said food product with movement of said food cutting assembly and said food support member toward each other.

31. The food preparation mechanism of claim 30, wherein said cutting edges of said four knife blades form straight lines.

32. The food preparation mechanism of claim 30, wherein said cutting edges of said four knife blades form curved lines.

* * * * *